US005591365A

United States Patent [19]

Shields

[11] Patent Number: 5,591,365

[45] Date of Patent: Jan. 7, 1997

[54] OPEN LATTICE SNOW MELTING APPARATUS

[76] Inventor: Christopher B. Shields, 3001 Ladue, Westlake Estates, Champaign, Ill. 61821

[21] Appl. No.: 273,122

[22] Filed: Jul. 14, 1994

[51] Int. Cl.[6] ..... H05B 1/00

[52] U.S. Cl. ..... 219/213; 219/528; 219/544; 219/549

[58] Field of Search ..... 219/213, 544, 219/528–529, 549; 52/169.11, 177; 404/95; 15/215

[56] References Cited

U.S. PATENT DOCUMENTS

| | | | |
|---|---|---|---|
| 2,619,580 | 11/1952 | Pontiere | 219/528 |
| 2,834,862 | 5/1958 | Meyers | 219/549 |
| 2,844,696 | 7/1958 | Custer, Jr. | 219/213 |
| 2,912,555 | 11/1959 | Jamison | 219/213 |
| 3,143,641 | 4/1964 | Wise | 219/549 |
| 3,437,967 | 4/1969 | Josse | 219/213 |
| 3,584,198 | 6/1971 | Doi et al. | 219/544 |
| 3,806,702 | 4/1974 | Spencer | 219/528 |
| 3,840,694 | 10/1974 | Luczak | 174/120 SR |
| 4,245,149 | 1/1981 | Fairlie | 219/549 |
| 4,564,745 | 1/1986 | Deschenes | 219/213 |
| 4,646,818 | 3/1987 | Ervin, Jr. | 165/703 |
| 4,889,973 | 12/1989 | Farinacci et al. | 219/528 |
| 4,967,057 | 10/1990 | Bayless et al. | 219/549 |
| 5,003,157 | 3/1991 | Hargrove | 219/213 |
| 5,291,000 | 3/1994 | Hornberger | 219/213 |

*Primary Examiner*—Teresa J. Walberg
*Assistant Examiner*—Raphael Valencia
*Attorney, Agent, or Firm*—Dorn, McEachran, Jambor & Keating

[57] ABSTRACT

A heating apparatus for preventing the accumulation of snow and ice, and having an apertured heating mat in the form of a lattice or web. The heating mat is made of a durable weatherproof insulative polymer so that the mat may be installed on any outdoor surface, such as a driveway, walkway, or rooftop. The apertures within the lattice serve to increase the flexibility of the mat, thus allowing the mat to fit uneven surfaces. In addition, this flexibility allows the mat to be easily rolled up when not in use, the apparatus therefore only occupying minimal storage space. The heating mat is also constructed to be highly resistant to wear and may be left outdoors for the entire snow season, exposed to both the elements and frequent vehicular traffic without losing its effectiveness. Also included is a controller from which the apparatus can be set to a manual mode, in which the apparatus may be manually activated, or an automatic mode, in which the apparatus is automatically activated by snowfall.

9 Claims, 3 Drawing Sheets

OPEN LATTICE SNOW MELTING APPARATUS

BACKGROUND OF THE INVENTION

1. Field of the Invention

The present invention relates to a heating apparatus to be used in conjunction with outdoor surfaces such as driveways and walkways to prevent the accumulation of snow and ice.

2. Description of the Prior Art

Heating elements have been used in the past to warm walkways and driving surfaces to prevent the accumulation of snow and ice. Past configurations, although effective, are lacking in several respects as will become apparent in the discussion that follows.

One solution to the problem of snow and ice accumulation is shown in U.S. Pat. No. 4,564,745 issued Jan. 14, 1986 to Maurice Deschenes. This patented invention utilizes a flexible electric heating element embedded in a fiber-reinforced mortar, forming a heating panel. Although adequate in operation, the heating panels must be placed within the concrete that forms the walkway or driveway. This configuration, therefore, may only be implemented with surfaces and structures which have not yet been formed. As such, these heating panels cannot be used with already existing surfaces.

Another solution to the problem of snow and ice accumulation is shown in U.S. Pat. No. 2,912,555 issued Mar. 10, 1958 to Frederick W. Jamison. Disclosed in this patent is a heating coil contained in a slab of concrete again forming a heating panel. Once placed into position on a chosen surface such as a driveway, the panel is anchored to that surface with toggle bolts or screws to prevent shifting. While this configuration adequately melts snow and ice and can withstand the weight of a vehicle, the panels are both heavy and inflexible. The inflexibility of the panels creates difficulty in mounting the panels on uneven or angled surfaces. The weight of the concrete panels creates further difficulty for the user during set-up and removal of the panels. Due to the weight of the panels, they would be required to be in the form of small sections. Thus, many panels would be required to cover large surface areas, adding to the inconvenience of the configuration.

U.S. Pat. No. 4,967,057 issued Oct. 30, 1990 to Ronald E. Bayless et al. improves on the Jamison arrangement by providing small individual heating mats constructed of rubber rather than concrete. These mats, primarily intended for outdoor steps, have the advantage of being much lighter than concrete slabs. While these mats work well for heating small areas such as outdoor steps, it would be impractical to use such a configuration to heat larger areas such as driveways since several such panels would be needed, making set-up tedious. Moreover, if several such panels were used, there would be substantial potential for disconnection and/or separation of the panels when the panels are walked or driven upon. If the panels were made in larger dimensions to reduce the number needed to cover a large surface area, storage of the panels would then be difficult, large sections of thick rubber paneling being both somewhat inflexible and heavy.

Another arrangement for the prevention of snow accumulation is disclosed in U.S. Pat. No. 3,806,702 issued Apr. 23, 1974 to David R. Spencer. In this patent, a heating mat, again using an internal conductive heating element, also employs a temperature sensor and a precipitation sensor so that the apparatus may operate automatically once snow begins to fall. Similar to several other such heating devices, the outer covering of the mat is constructed of an electrically insulative material such as rubber. While quite practical for small applications, this configuration would also be highly impractical for larger applications such as a driveway since, as with the Bayless et al. patent teachings, a large mat would be both heavy and difficult to store. In addition, water pooling could occur if the mat was used on a level surface since no drainage means is provided.

Other such heating mats are shown in U.S. Pat. No. 2,619,580 issued Nov. 25, 1952 to Stanley M. Pontiere, U.S. Pat. No. 2,844,696 issued Jul. 22, 1958 to Byron K. Custer, Jr., and U.S. Pat. No. 3,143,641 issued Aug. 4, 1964 to Robert A. Wise.

None of the above inventions and patents, taken either singly or in combination, is seen to describe the instant invention as claimed.

SUMMARY OF THE INVENTION

The present invention relates to an improved snow melting apparatus for use with driveways, walkways, rooftops and other such surfaces that are exposed to snowfall and the accumulation of ice. The apparatus employs an apertured electrical heating mat that is in the basic form and shape of a thin web or lattice. This heating mat is constructed of a lightweight, durable material such as a selected, industrial strength vulcanized polymer, similar to the material used in temporary barrier fencing. Being extremely tough, this heating mat is highly resistant to tearing or ripping and as such may be exposed to frequent foot and automobile traffic. Because of its light weight, the heating mat may be easily set-up on the chosen surface and secured in place by being drawn taut by elastic tethers attached to structure or held tight by stakes driven into the ground. When the heating apparatus is no longer required for snow and ice melting, the heating mat may be easily rolled up in preparation for storage. Once rolled up, the entire heating apparatus occupies only minimal storage space. One distinct advantage of the web-like configuration is that the apertures within the lattice arrangement of the mat serve to further reduce the weight of the mat by decreasing the amount of material used. In addition, these apertures also provide for superior drainage of accumulated water resulting from falling rain or melting snow.

Sinusoidally configured within the heating mat is an electrical resistance heating element that provides heat to the heating mat when snow or ice is to be melted. This heating element may be in the form of a standard electric cable, having a hot insulated conductor and a neutral insulated conductor, both wrapped with a braided ground to protect against potential shock in the unlikely event that the heating mat were punctured. Running the entire length of the cable, and also enclosed within the heating mat, are grounding foils, one located above the cable and one below, that serve as a second protection against injury from electric shock.

In a first embodiment of the present invention, the heating cable extends from the heating mat, terminating with a standard electric plug. The heating apparatus connects to a standard outdoor receptacle with the plug, the receptacle preferably having ground fault interruption (GFI) protection. As a further protective measure, the plug contains a standard in-line fuse to prevent power surges from reaching the heating cable.

In another embodiment, the heating apparatus is also equipped with a controller with which the apparatus may be switched to a manual mode, an automatic mode, or turned off. Enclosed in a waterproof casing, the electrical circuitry within the controller is protected from the elements such as rain and snow.

Accordingly, it is a principal object of the invention to provide a snow and ice melting apparatus having superior drainage properties and convenience of use due to its lattice configuration.

It is another object of the invention to provide a snow and ice melting apparatus that is lightweight so that it may be easily transported and placed into position on a chosen surface.

It is a further object of the invention to provide a snow and ice melting apparatus that may be easily rolled up for storage.

Still another object of the invention is to provide a snow and ice melting apparatus that is durable enough to be driven upon by vehicles on a regular basis while still maintaining optimal operation.

It is still a further object of the invention to provide a snow and ice melting apparatus activated by snowfall that will automatically prevent the accumulation of snow.

It is an additional object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
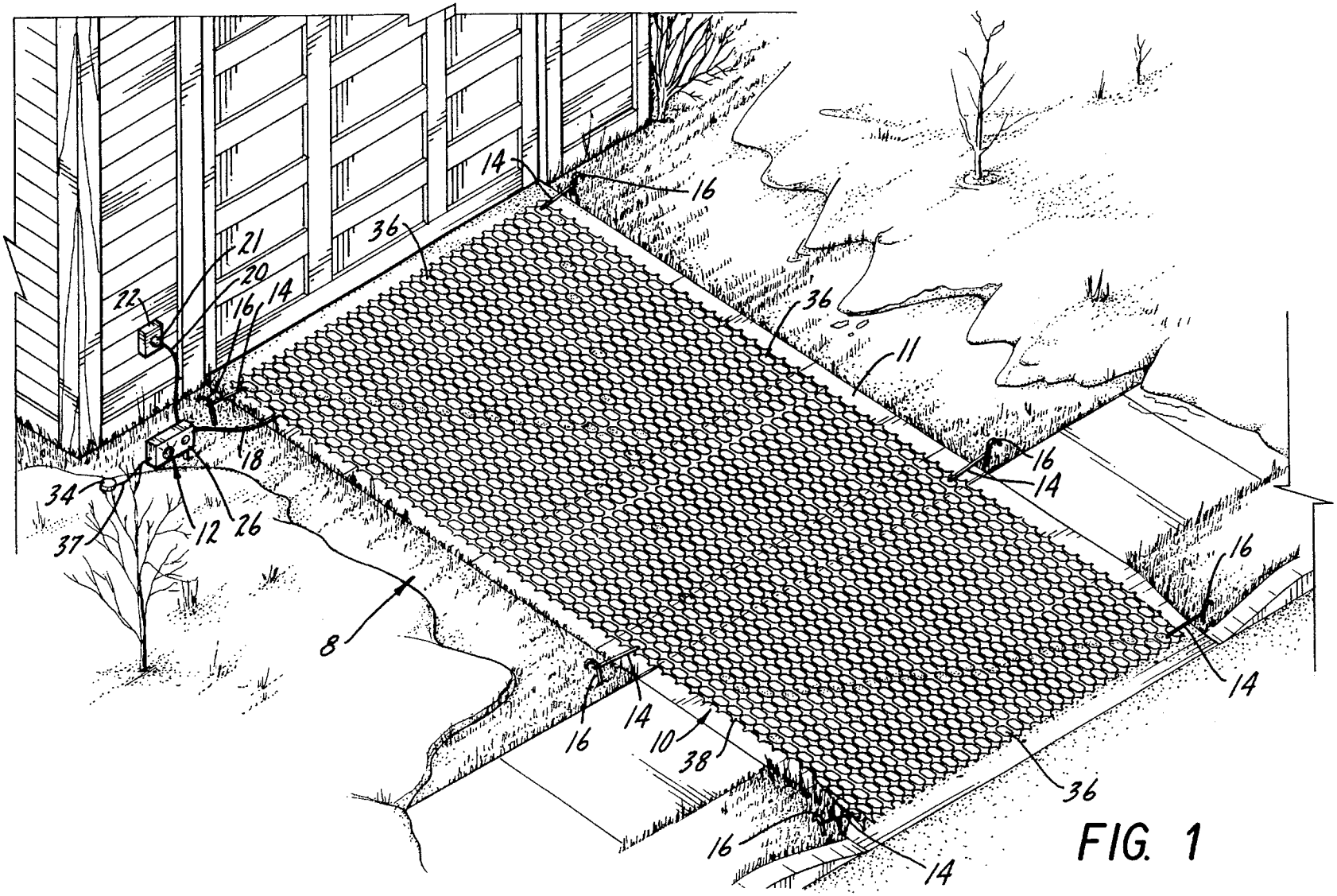
FIG. 1 is an environmental perspective view of the heating apparatus shown in place on a standard home driveway.

Referring first to FIG. 1, the heating apparatus identified generally as 8 is shown installed on a typical driveway 12. Although shown in conjunction with this surface, it will be appreciated that the apparatus 8 could be positioned on other surfaces exposed to snowfall such as a walkways or rooftops. A heating mat 10 is shown extended, covering the majority of the driveway 12. The heating mat 10 is secured in this position with elastic tethers 14 drawn taut by stakes 16 driven into the ground. The heating mat 10 is electrically linked to an operation controller 12 with an external portion of electric heating cable 18 substantially enclosed in heating mat 10. The controller 12 is supplied with electricity from an electric cord 20 having a male plug 21 that connects to a standard outdoor receptacle 22. This receptacle 22 preferably has ground fault interruption (GFI) protection and provides electric power at 110 volts and 20 amperes. As an additional protection, the male plug 21 may contain a standard 20 ampere in-line fuse (not shown).

The controller 12 comprises a waterproof plastic casing 26 which protects the internal circuitry of the controller 12 from the elements. As detailed in FIG. 5, a control knob 28 and an indicator light 30 are located on the face 27 of the controller 12. The control knob 28 is used to select the desired operation mode of the heating apparatus 8. When the heating apparatus 8 is activated, the indicator light 30 is illuminated, making this condition evident to the user. Integral with the controller 12 are support legs 32 that insert into the ground to stabilize the controller 12 in place. Alternatively, the controller 12 may be secured to an existing structure such as a wall surface.

The controller 12 is also electrically linked to a sensor device 34 with an electrical cord 37 as shown in FIG. 1. This sensor device 34 has both precipitation and temperature sensing capability and thus serves to activate the heating apparatus 8, i.e., supply the electric heating cable 18 with electric power thereby heating mat 10, when predetermined parameters are achieved.

Figure 2:
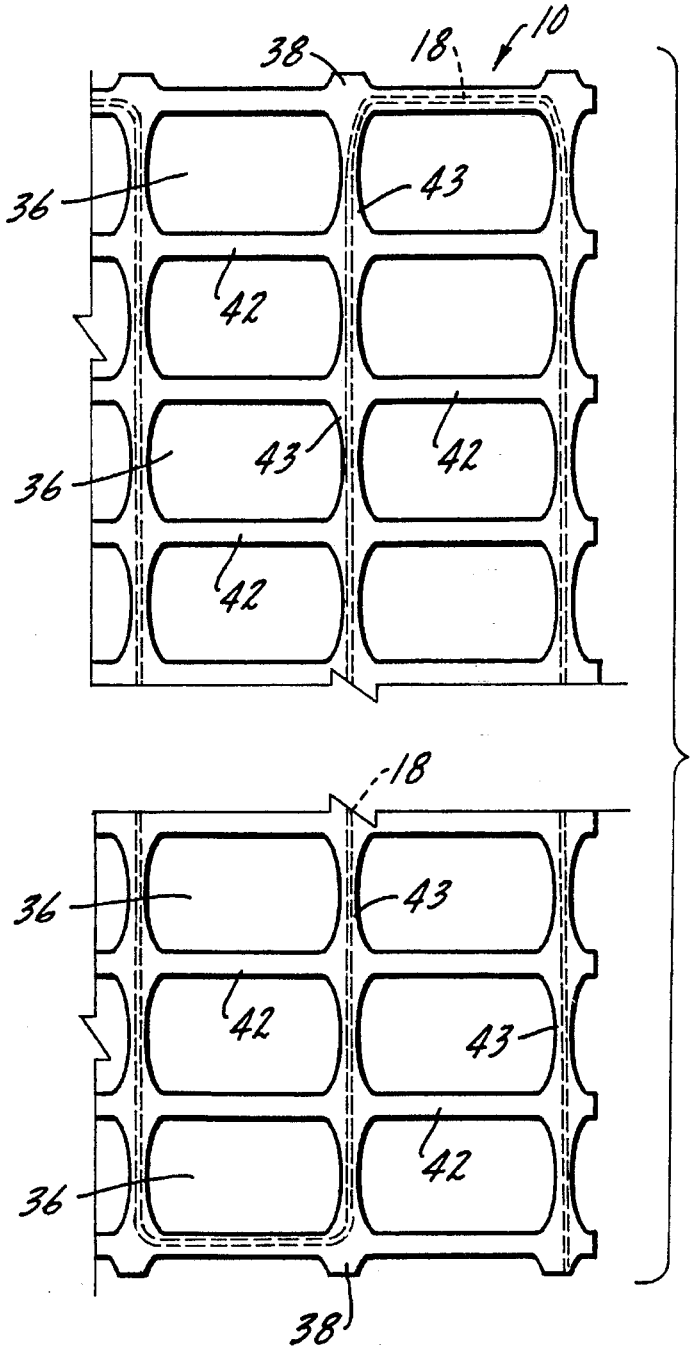
FIG. 2 is an enlarged scale, top plan view of the heating mat, illustrating in phantom lines the configuration of the electric heating element within the heating mat.

As best shown in FIGS. 1 and 2, the heating mat 10 has a multiplicity of roughly rectangular apertures 36. These apertures 36 allow for superior drainage of water and other debris that accumulate from rainfall or the melting of snow. In addition, the apertures 36 serve to reduce the overall weight and expense of the heating mat by reducing the amount of material used during manufacture of the heating apparatus 8. The exterior casing 38 of the heating mat 10 is a flexible lightweight material fabricated from an industrial strength vulcanized plastic such as polyethylene, polypropylene, or similar polymeric material. Such a material has many advantages, including toughness, resiliency, and light weight. This durability is necessary in that the heating mat 10 is intended to be left in place on a surface such as a driveway by the user for the entire snowfall season, the mat thus being exposed to the elements and/or driven upon frequently. The durability of the material also serves to keep the required thickness of the heating mat 10 to a minimum, the greatest thickness of the heating mat being approximately one half inch.

Figure 3:
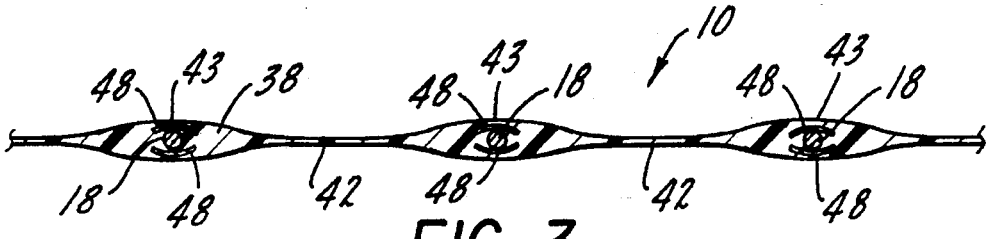
FIG. 3 is a fragmentary, cross-sectional view of a portion of the heating mat as shown in FIG. 2.

As indicated in FIGS. 2 and 3, electric heating cable 18 is substantially enclosed within the exterior casing 38 of heating mat 10. The heating cable 18 is sinusoidally arranged within the heating mat 10 and is embedded within relatively thick web portions 43. Arranged transversely to the thick web portions 43 are thin web portions 42 through which the cable 18 does not travel. These thin web portions 42 allow the heating mat 10 to be easily rolled up lengthwise for storage when the heating apparatus is no longer needed. The thin web portions 42 also serve to give the heating mat 10 increased flexibility so that it may maintain maximum contact with the contours of an uneven or angled surface.

Figure 4:
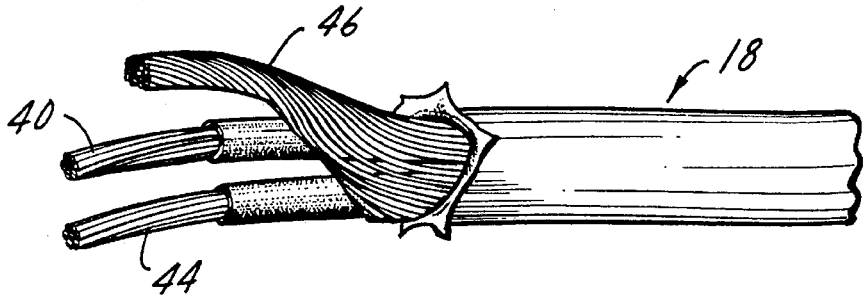
FIG. 4 is a is a fragmentary, perspective, part-sectional view of the electric heating cable.

Further depicted in FIG. 3 is a cross-sectional view of heating cable 18 encased within thick web portions 43. The diameter of the cable 18 is small, again keeping weight of the apparatus 8 to a minimum while still providing adequate heating power to prevent the accumulation of snow and ice. This cable 18 contains two insulated conductors, namely a hot cable 40 and a neutral cable 44 as shown in FIG. 4. These cables 40,44 serve to complete the electrical circuit within the heating mat 10 when the heating apparatus 8 is activated, the current traveling along the hot wire through the entire heating mat 10, and returning from the heating mat 10 along the neutral cable 44. Each cable 40,44 is constructed of an electrically resistive material such as material sold under the trademark NICHROME, german silver, graphited thread, silicone carbide, or iron alloy. A braided ground 46 constructed of a conductive material completely surrounds both the hot and neutral cables 40,44 to protect against injury from electric shock, grounding the heating apparatus 8 should a short circuit occur. As an additional safety feature, grounding foils 48 are included within the exterior casing 38; the foils 48 are also connected to ground as shown in FIG. 3. These foils 48 are positioned above and below the cable 18, running its entire length within the heating mat 10. This configuration is optimal for providing a further protection against possible electric shock if the heating mat 10 is somehow punctured or torn exposing the cable 18 to the environment.

Figure 5:
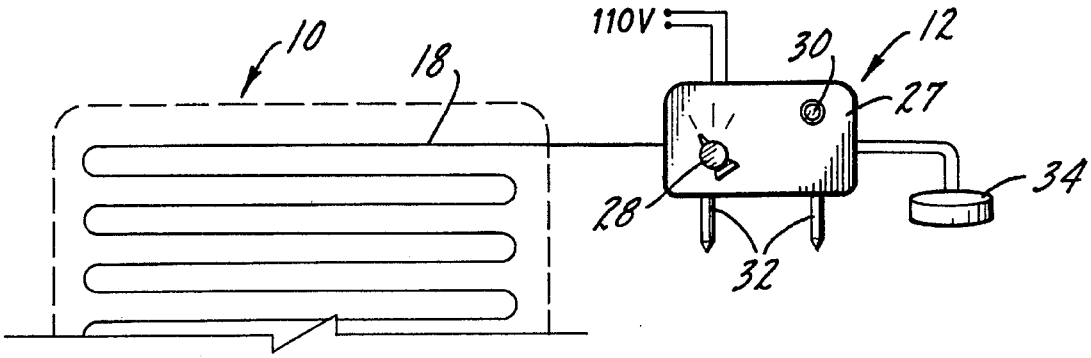
FIG. 5 is a schematic diagram and detail view of the control system of the present invention.

Once the heating apparatus 8 is arranged as shown generally in FIG. 1, the apparatus 8 can be operated in either a manual or automatic mode. As depicted in FIG. 5, the operation mode is selected with the control knob 28, being able to be switched to manual, off, or automatic. When in the manual mode, the heating apparatus 8 is activated and the heating cable 18 receives electricity, thereby creating heat due to the resistance in the cable 18 which, in turn, warms the heating mat 10, melting snow as it settles upon the surface. While activated in this fashion, the indicator light 30 is illuminated, indicating to the user that the heating mat 10 is heating the surface. In the automatic mode, the heating cable 18 is initially not supplied with electricity. However, once the sensor device 34 measures a predetermined temperature, such as 35 degrees fahrenheit or less, and also senses the presence of precipitation, the heating cable 18 receives electric current, the indicator light 30 is illuminated, and the heating mat 10 begins to melt the settling snow. This mode is desirable for situations in which it would be inconvenient for user to activate the apparatus 8 when the snow begins to fall, as when snowfall is expected overnight or while the user is away from home. This mode provides an added advantage in that the heating apparatus 8 need only be activated when snow is actually falling, thus saving electricity.

When the heating apparatus 8 is activated, the heating mat 10 reaches an exterior operating temperature in the range of 75 to 80 degrees fahrenheit. This warmth quickly melts the falling snow, eliminating approximately 2.5 to 3.0 inches of snow per hour.

Figure 6:
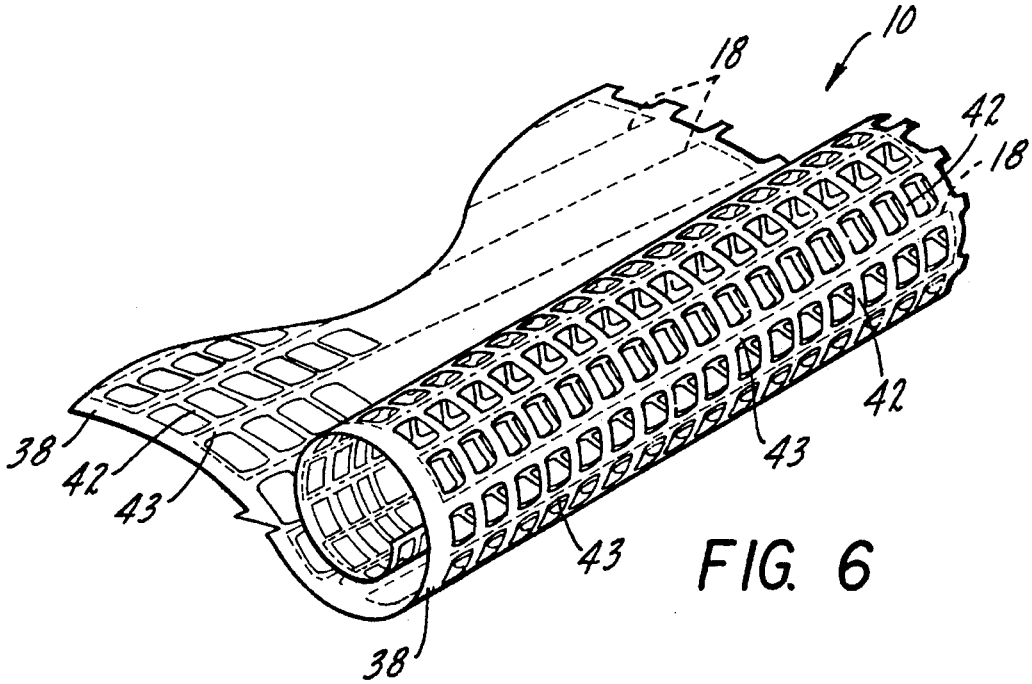
FIG. 6 is partial perspective view of the heating mat being rolled up for storage, and showing the configuration of the electric heating cable within the heating mat.

When the heating apparatus 8 is not needed, as during warmer seasons, the apparatus 8 may be easily stored, occupying only a minimal amount of storage space. As described above, the heating mat 10 may be easily rolled up lengthwise as shown in FIG. 6. The ease of rolling is due in part to the thinness of the thin web portions 42 of the flexible exterior casing 38 as seen most clearly in FIG. 3, and in part due to the arrangement of the heating cable 18 which runs substantially entirely within the thick web portions 43, also seen in FIG. 6.

It is to be understood that the present invention is not limited to the sole embodiment described above, but encompasses any and all embodiments within the scope of the following claims.

I claim:

1. A heating apparatus for preventing the accumulation of snow and ice on an outdoor surface, said heating apparatus comprising:

a) a flexible heating mat configured as an open lattice arrangement, said heating mat having a weatherproof electrically insulative exterior casing, said mat including thin web portions running transverse to relatively thick web portions aligned within said lattice arrangement; and b) an electric heating element sinusoidally arranged and embedded within said heating mat, said electric heating element being substantially encased in said thick web portions.

2. The heating apparatus according to claim 1, wherein said electrically insulative exterior casing is an industrial strength vulcanized polymer.

3. The heating apparatus according to claim 1 wherein said electric heating element is a multiple conductor electric heating cable having an exterior insulation layer, said electric heating cable having an internal braid of ground wires encased by said insulation layer.

4. The heating apparatus according to claim 3 further comprising electrically conductive grounding foils encased within said heating mat, said grounding foils running the entire length of said electric heating cable.

5. The heating apparatus according to claim 3 wherein said heating cable extends from said heating mat and terminates with a male electrical plug.

6. The heating apparatus according to claim 5 wherein said electric heating cable includes a controller box which is used to activate and deactivate said heating apparatus, said controller box having a control knob and an indicator light.

7. The heating apparatus according to claim 6 further comprising a sensor device electrically linked to said controller box, said sensor device being capable of measuring air temperature and detecting the presence of precipitation.

8. A heating apparatus for preventing the accumulation of snow and ice on an outdoor surface, said heating apparatus comprising:

a) a flexible heating mat configured as an open lattice arrangement, said heating mat having a weatherproof electrically insulative exterior casing;

b) an electric heating element sinusoidally arranged and embedded within said heating mat; and c) a multiplicity of elastic tethers arranged along outer edges of said heating mat for securing said heating mat in position on an outdoor surface.

9. The heating apparatus according to claim 8 further comprising a multiplicity of metallic ground stakes for engaging said elastic tethers to further secure said heating mat.

* * * * *